US011575226B2

(12) United States Patent
Mininger et al.

(10) Patent No.: US 11,575,226 B2
(45) Date of Patent: Feb. 7, 2023

(54) PASS-THROUGH PLUG

(71) Applicant: TXS Industrial Design, Inc., Richardson, TX (US)

(72) Inventors: Staci Mininger, Richardson, TX (US); Timothy Wayne Terleski, Richardson, TX (US); Meridith Martin, Richardson, TX (US)

(73) Assignee: TXS INDUSTRIAL DESIGN, INC., Richardson, TX (US)

( * ) Notice: Subject to any disclaimer, the term of this patent is extended or adjusted under 35 U.S.C. 154(b) by 0 days.

(21) Appl. No.: 17/173,403

(22) Filed: Feb. 11, 2021

(65) Prior Publication Data

US 2022/0255256 A1 Aug. 11, 2022

(51) Int. Cl.

| | |
|---|---|
| ***H01R 13/50*** | (2006.01) |
| ***H01R 13/453*** | (2006.01) |
| ***H01R 13/506*** | (2006.01) |
| ***H01R 13/633*** | (2006.01) |
| ***H01R 27/02*** | (2006.01) |

(52) U.S. Cl.

CPC ..... *H01R 13/4532* (2013.01); *H01R 13/506* (2013.01); *H01R 13/6335* (2013.01); *H01R 27/02* (2013.01)

(58) Field of Classification Search

CPC .. H01R 13/447; H01R 13/5213; H01R 13/64; H01R 13/44; H01R 13/52; H01R 13/4538; H01R 24/28

See application file for complete search history.

(56) References Cited

U.S. PATENT DOCUMENTS

| | | | | |
|---|---|---|---|---|
| 7,484,972 | B1 * | 2/2009 | Kuo | H01R 35/04 439/131 |
| 8,182,274 | B1 * | 5/2012 | Cheng | H01R 35/04 439/131 |
| 10,170,878 | B1 * | 1/2019 | Reulman, Sr. | H01R 9/2408 |
| 2002/0119692 | A1 * | 8/2002 | Burton | H01R 13/6395 439/346 |
| 2003/0181082 | A1 * | 9/2003 | Wu | H01R 27/00 439/131 |
| 2004/0014339 | A1 * | 1/2004 | Machado | H01R 13/652 439/105 |
| 2005/0026482 | A1 * | 2/2005 | Huang | H01R 13/4536 439/145 |
| 2007/0232152 | A1 * | 10/2007 | Hong | H01R 13/2428 439/700 |
| 2008/0009189 | A1 * | 1/2008 | Wu | H01R 13/6658 439/607.51 |
| 2010/0067160 | A1 * | 3/2010 | Li | H01H 83/04 361/93.6 |

(Continued)

*Primary Examiner* — Truc T Nguyen

(74) *Attorney, Agent, or Firm* — Peter J. Ims; Westman, Champlin & Koehler, P.A.

(57) ABSTRACT

The present application provides a pass-through plug, including: a first housing, comprising a plurality of sockets; a second housing, configured to be connected with the first housing; and a tamper resistant assembly, trapped between the first housing and the second housing and configured to selectively block the plurality of sockets when the plurality of sockets are not simultaneously operated. The provided pass-through plug can reduce the potential risk of people accidentally inserting conductive objects into the socket holes.

18 Claims, 10 Drawing Sheets

(56) References Cited

U.S. PATENT DOCUMENTS

| | | | | |
|---|---|---|---|---|
| 2011/0104919 | A1* | 5/2011 | Patel | H01R 13/70<br>439/620.22 |
| 2011/0111634 | A1* | 5/2011 | Ruffner | H01R 31/06<br>439/628 |
| 2012/0094511 | A1* | 4/2012 | Sil | H01R 24/78<br>439/535 |
| 2012/0142208 | A1* | 6/2012 | Peng | H01R 31/06<br>439/345 |
| 2014/0038439 | A1* | 2/2014 | Lee | H01R 13/4534<br>439/95 |

* cited by examiner

PASS-THROUGH PLUG

TECHNICAL FIELD

The present application relates to the technical field of socket structure, and more particularly to a pass-through plug.

BACKGROUND

The American standard plugs are generally active, which means that they always provide power to the contacts in the electrical socket. Therefore, children and even some elderly people are prone to electric shock when a conductive object is inserted into the socket hole of the plug. The conductive objects may include knives, paper clips, screwdrivers, or similar objects that a person can insert into the socket holes. Most existing sockets do not provide such a device for reducing the potential risk of a person accidentally inserting a conductive object into the socket holes.

SUMMARY

An object of the present application is to provide a pass-through plug, to provide an additional socket once the pass-through plug is plugged into a socket, and can also reduce the potential risk of people accidentally inserting conductive objects into the socket holes.

In the present application, a pass-through plug is provided, which includes: a first housing including a plurality of sockets; a second housing, configured to be connected with the first housing; and a tamper resistant assembly, trapped between the first housing and the second housing and configured to selectively block the plurality of sockets when the plurality of sockets are not simultaneously operated. With the first housing and the second housing are connected through a one-time snap feature, such that the manufacturing assembly process of the plug is more convenient, and the tamper resistant assembly is trapped between the first housing and the second housing.

In an embodiment of the present application, the first housing includes a plate portion, the second housing includes a frame portion with an end providing an opening, and the plate portion closing the opening when the first housing is connected with the second housing.

In an embodiment of the present application, the plate portion is configured for the plurality of sockets to pass through, and comprises a first surface and a second surface opposite to the first surface; and the first housing further includes: a first connecting plate extending outwardly perpendicular to the second surface, and an extending end of the first connecting plate is provided with a first engagement portion. The first housing further includes: a second connecting plate, extending outwardly perpendicular to the second surface, and an extending end of the second connecting plate is provided with a second engagement portion. The first engagement portion and the second engagement portion are engaged onto the second housing when the first housing is connected with the second housing.

In an embodiment of the present application, the second housing includes: a frame portion including a first side plate and a second side plate that are perpendicular to each other. The first side plate being provided with a first connection groove configured for connecting the first connecting plate, and the second side plate being provided with a second connection groove configured for connecting the second connecting plate. A bottom of the first connection groove is further provided with a first groove configured for the first engagement portion to be engaged, and a bottom of the second connection groove is further provided with a second groove configured for the second engagement portion to be engaged.

In an embodiment of the present application, the tamper resistant assembly includes: a supporting member, providing with a receiving groove, and a bottom of the receiving groove being provided with at least a first insertion slot and a second insertion slot that are in parallel. the tamper resistant assembly includes a shutter assembly limited into the receiving groove and configured to rotate relative to the receiving groove to block the plurality of sockets, or to slide such that the plurality of sockets communicate with the first insertion slot and the second insertion slot respectively.

In an embodiment of the present application, the shutter assembly includes an upper arch portion and a lower arch portion, a top of the upper arch portion being movably in contact with the plate portion, and a top of the lower arch portion being movably in contact with a bottom of the receiving groove.

In an embodiment of the present application, the upper arch portion is configured to be able to slide at the plate portion when the plurality of sockets are not simultaneously operated, and to rotate relative to the plate portion when the plurality of sockets are simultaneously operated; and the lower arch portion is configured to be able to slide on the bottom of the receiving groove when the plurality of sockets are not simultaneously operated, and to rotate relative to the bottom of the receiving groove when the plurality of sockets are simultaneously operated.

In an embodiment of the present application, the pass-through plug further includes a prong assembly trapped between the tamper resistant assembly and the second housing.

In an embodiment of the present application, the prong assembly includes: a pin part extending out of the second housing; a prong part configured to be abutted against the tamper resistant assembly; and a wiring part, configure to connect cables.

In an embodiment of the present application, the wiring part includes a first connection portion configured to fixedly connect at least one first cable, and second connection portion configured to fixedly connect at least one second cable, wherein the first connection portion and the second connection portion are limited and abutted against at an inner wall of the frame portion when the pin part is extended outside of the second housing.

In an embodiment of the present application, the frame portion includes a third side plate opposite to the opening, and the third side plate being provided with a plurality of slots configured for the pin part to be passed through the second housing, wherein a plurality of flanges corresponding to the plurality of slots are formed along the inner wall of the third side plate and extending perpendicularly to an inside of the frame portion, and the flanges being configured for the wiring part to be correspondingly connected thereon.

In an embodiment of the present application, the flange is formed by extending around outer circumference of the slots, and extending ends of the flanges are further provided with connecting grooves for limiting the wiring part.

In an embodiment of the present application, the prong part includes at least a first prong connection member abutted the first insertion slot and a second prong connection member abutted the second insertion slot, and the first prong connection member and the second prong connection member being configured to in contact with external pins passing through the first insertion slot and the second insertion slot when the plurality of sockets are simultaneously operated.

In an embodiment of the present application, the first prong connection member and the second prong connection member have the same structure; and the first prong connection member includes a first portion having a funnel-shaped and located at a front end; a flat second portion connected with the first portion and configured to in contact with the external pins; and a third portion connected with the second portion and expanded to strengthen the strength of the first prong connection member.

In an embodiment of the present application, the frame portion further includes a fourth side plate provided with a slot configured for the cables to pass through.

In an embodiment of the present application, the frame portion further includes a fourth side plate provided with a sliding groove, and an end of the sliding groove facing the opening, and the other end of the sliding groove forming an arc-shaped end. The plate portion is configured for the plurality of sockets to pass through, and includes a first surface and a second surface opposite to the first surface; the plate portion further includes a third connection plate extended outwardly perpendicular to the second surface, to slidably connect to the sliding groove, and wherein an extending end of the third connection plate is concavely provided with an arc-shaped inner arch, and the inner arch and the arc-shaped end of the sliding groove forming a channel for the cables to pass through.

In an embodiment of the present application, the pass-through plug further includes a protective cover molded outside the first housing and the second housing.

In an embodiment of the present application, the pass-through plug further includes a protective cover molded outside the first housing and the second housing, and an outer surface of the plate portion further provided with a connection step to which the protective cover is able to be attached. The protective cover encases the entire assembly and prevents disassembly or tampering.

In an embodiment of the present application, an outer surface of the second housing further includes a plurality of recesses configured to enhance adhesion strength of the protective cover to the second housing.

In an embodiment of the present application, the protective cover further includes an auxiliary handle configured to facilitate pulling out the pass-through plug.

In the present application, the pass-through plug includes the first housing and the second housing, and the first housing and the second housing are connected, and optionally through a one-time snap feature, such that the assembling process is achieved through a one-time snap feature in place of using screws to fasten the assembly together. In addition, the tamper resistant assembly is fixedly or movably connected between the first housing and the second housing, and the tamper resistant assembly is able to block the plurality of sockets when the plurality of sockets are not simultaneously operated (e g. when one of the sockets is inserted by a metal member), thereby providing a pass-through plug with a simple structure, and the pass-through plug provides an additional socket once the pass-through plug is plugged into a socket and able to avoid accidental touch.

BRIEF DESCRIPTION OF THE DRAWINGS

In order to explain the embodiments of the present application more clearly, a brief introduction regarding the accompanying drawings that need to be used for describing the embodiments of the present application or the prior art is given below; it is obvious that the accompanying drawings described as follows are only some embodiments of the present application, for those skilled in the art, other drawings can also be obtained according to the current drawings on the premise of paying no creative labor.

DETAILED DESCRIPTION

In order to make the purpose, the technical solution and the advantages of the present application be clearer and more understandable, the present application will be further described in detail below with reference to accompanying figures and embodiments. It should be understood that the specific embodiments described herein are merely intended to illustrate but not to limit the present application.

It is noted that when a component is referred to as being "fixed to" or "disposed on" another component, it can be directly or indirectly on another component. When a component is referred to as being "connected to" another component, it can be directly or indirectly connected to another component.

In the description of the present application, it needs to be understood that, directions or location relationships indicated by terms such as "length", "width", "up", "down", "front", "rear", "left", "right", "vertical", "horizontal", "top", "bottom", "inside", "outside", and so on are the directions or location relationships shown in the accompanying figures, which are only intended to describe the present application conveniently and simplify the description, but not to indicate or imply that an indicated device or component must have specific locations or be constructed and manipulated according to specific locations; therefore, these terms shouldn't be considered as any limitation to the present application.

In addition, terms "the first" and "the second" are only used in describe purposes, and should not be considered as indicating or implying any relative importance, or impliedly indicating the number of indicated technical features. As such, technical feature(s) restricted by "the first" or "the second" can explicitly or impliedly comprise one or more such technical feature(s). In the description of the present application, "a plurality of" means two or more, unless there is additional explicit and specific limitation.

As shown in FIGS. 1 to 4, in the present application, a pass-through plug is provided. The pass-through plug includes a first housing 10, the first housing 10 includes a plurality of sockets 11, or the first housing 10 is provided with a plurality of sockets 11; the plurality of sockets 11 are configured to match the pins of the adapter plug. The pass-through plug further includes a second housing 20 that is configured to be detachably connected to the first housing 10, the detachable connection here is applicable to any existing detachable way. The pass-through plug further includes a tamper resistant assembly 30, which is trapped between the first housing 10 and the second housing 20 and configured to selectively block the plurality of sockets 11 when the plurality of sockets 11 are not simultaneously operated, and when the plurality of sockets 11 are simultaneously operated, the pins of the external plug can easily pass through the tamper resistant assembly 30.

Figure 1:
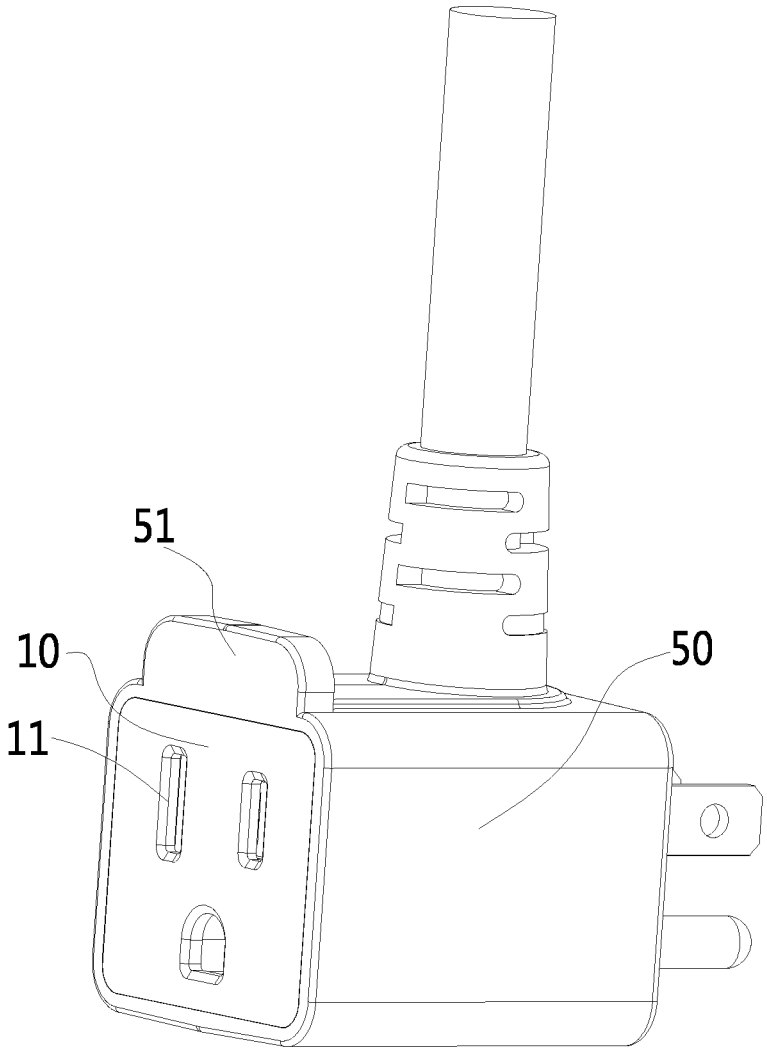
FIG. 1 is a perspective structural view of a pass-through plug provided by an embodiment of the present application.
Figure 2:
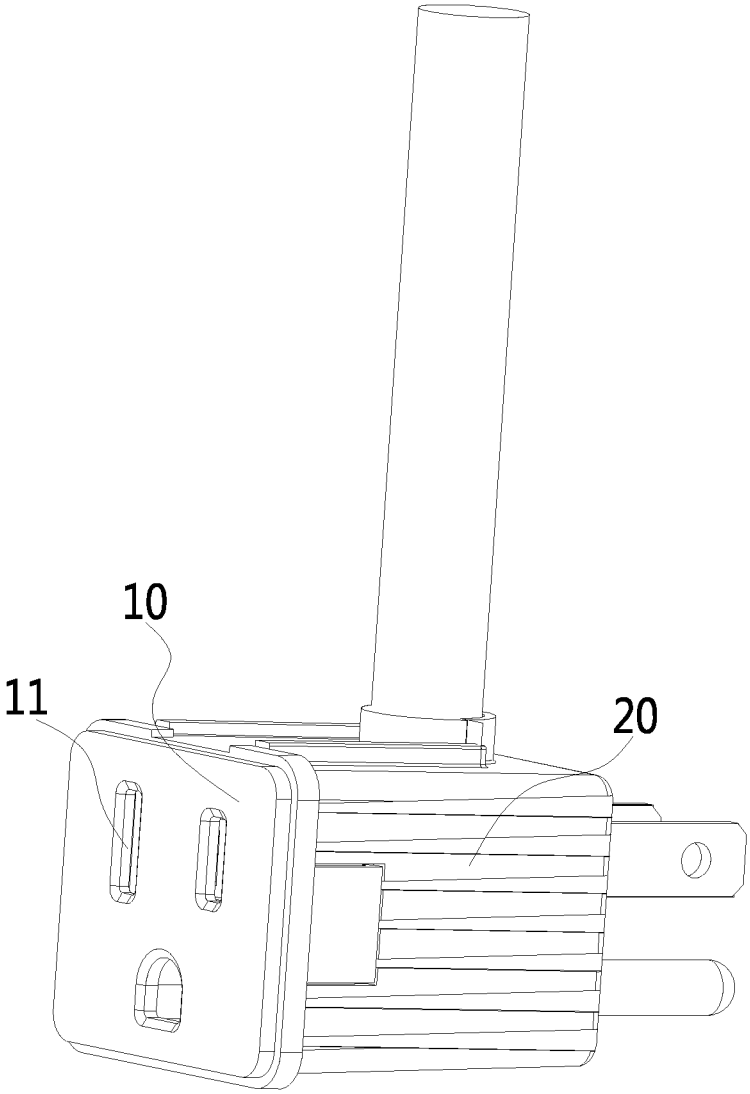
FIG. 2 is a perspective structural view of a pass-through plug with a protective cover being removed provided by an embodiment of the present application.
Figure 3:
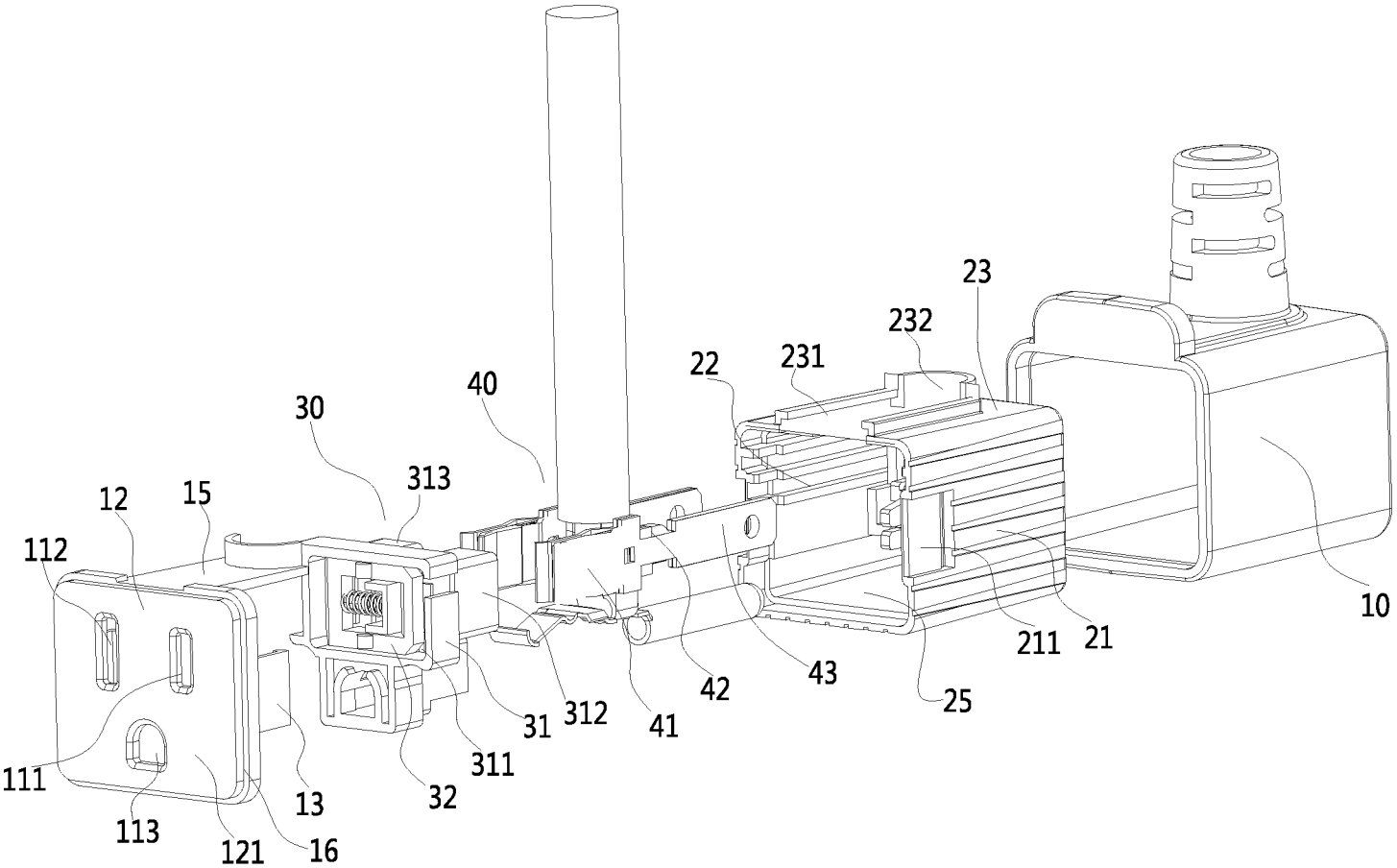
FIG. 3 is a structural explosion view of a pass-through plug provided by an embodiment of the present application.
Figure 4:
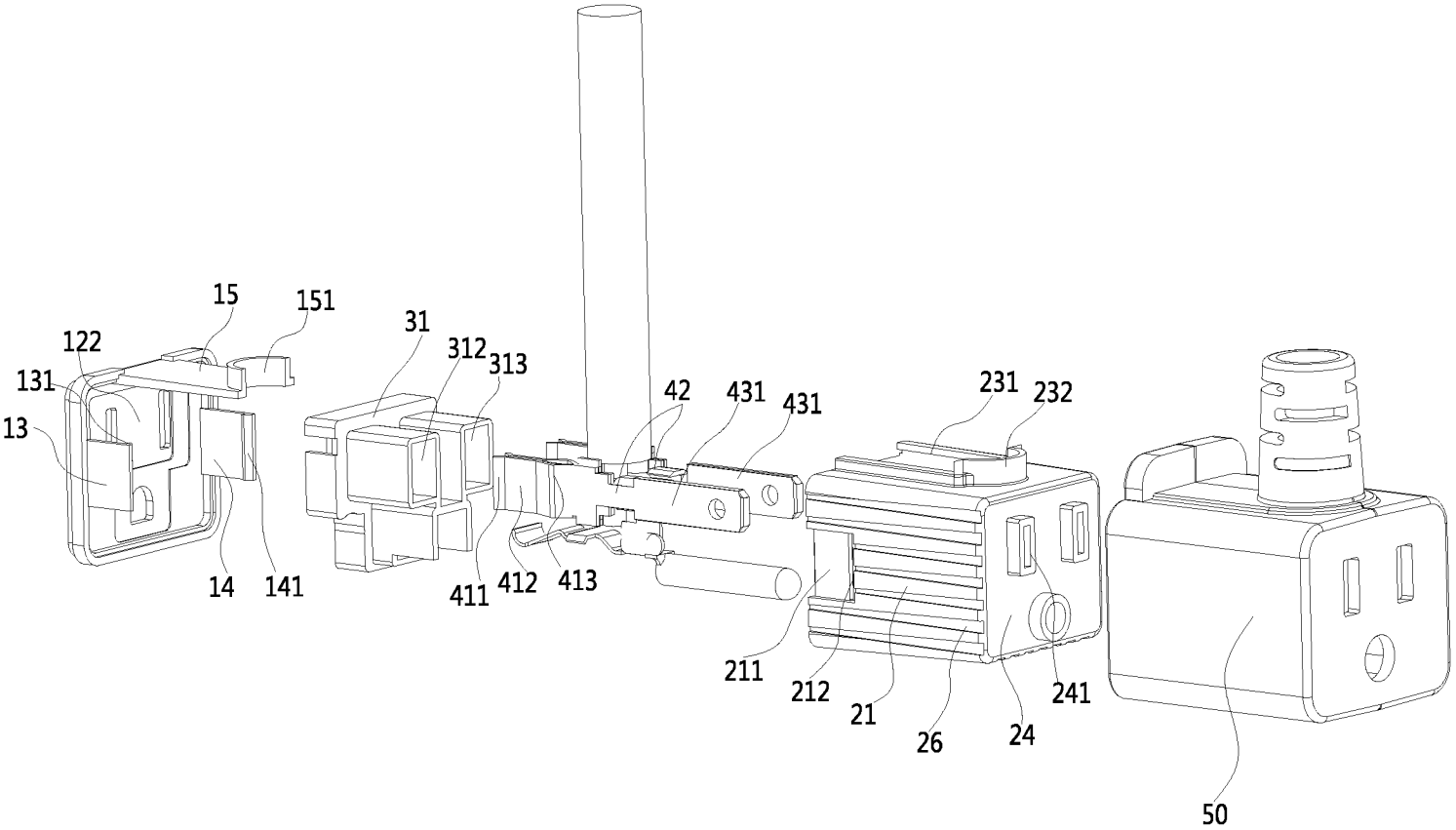
FIG. 4 is another structural explosion view of a pass-through plug provided by an embodiment of the present application.

In an embodiment of the present application, referring to FIGS. 3-4, the first housing 10 can be connected with the second housing 20 to form a closed or semi-closed space. The first housing 10 includes a plate portion 12 configured to allow the plurality of sockets 11 to pass through, and includes a first surface 121 and a second surface 122 opposite to the first surface 121. Among then, the first surface 121 preferably faces away from the second housing 20, and the second surface 122 preferably faces the second housing 20. That is, the plate portion 12 includes a structure similar to a panel, and the panel is provided with a number of penetrating sockets. In the present embodiment, the number of the sockets is preferably three, and they are respectively a first socket 111 and a second socket 112 in parallel, and a third socket 113 for a grounding pin of the socket located below the first socket 111 and the second socket 112. This is only an example, of course, the number of sockets can also be any number greater than three or lesser than three.

In an embodiment of the present application, as shown in FIGS. 3 and 4, the second housing 20 is preferably a frame structure and includes a frame portion, one end of the frame portion is provided with an opening 25, and other side surfaces and the side opposite to the opening 25 is preferably provided with side plates. In the present application, the first housing 10 closed the opening 25 after the first housing 10 and the second housing 20 are assembled and connected, to form a cavity configured for accommodating tamper resistant assembly 30 and other components.

In an embodiment of the present application, as shown in FIGS. 3 to 6, the first housing 10 may further include a first connection plate 13 and a second connection plate 14 that are extended in a direction perpendicular to the second surface 122 of the plate portion 12 and toward the second housing 20. The extending ends of the first connecting plate 13 and the second connecting plate 14 are further formed with a first engagement portion 131 and a second engagement portion 141 respectively. The first engagement portion 131 and the second engagement portion 141 are configured to be engaged onto the surface of the second housing 20 when the first housing 10 and the second housing 20 are connected, so as to ensure the stability of the connection between the first housing 10 and the second housing 20.

Figure 5:
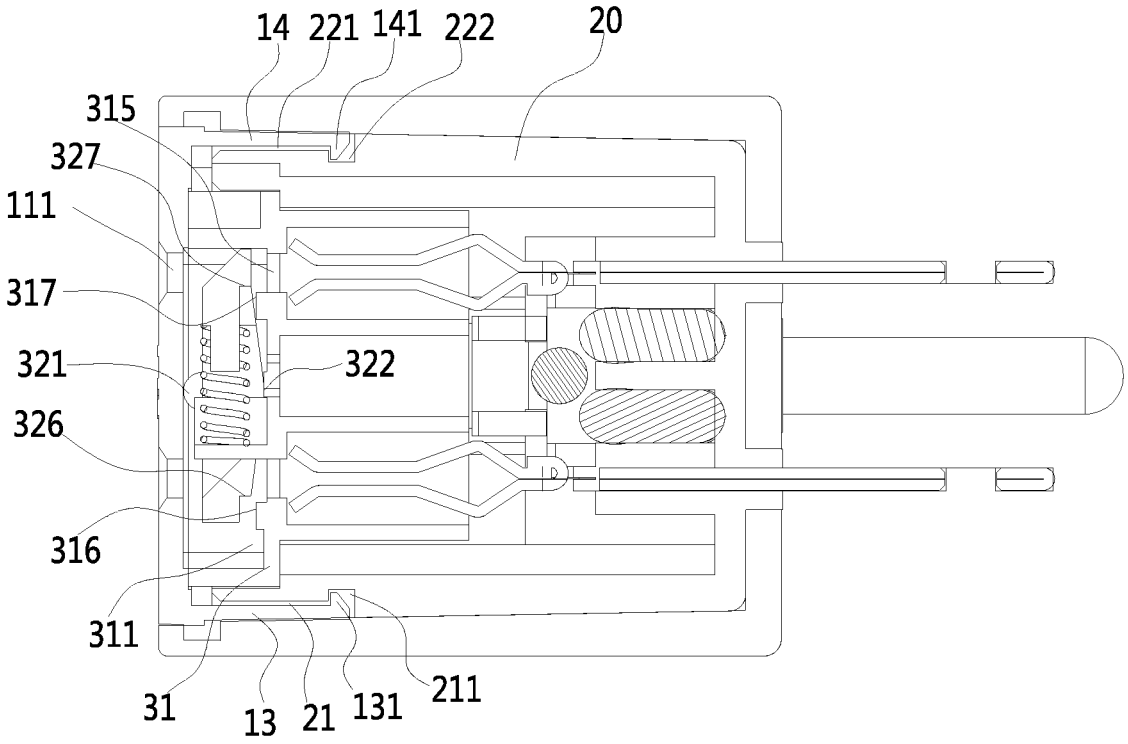
FIG. 5 is a cross sectional view of a pass-through plug provided by an embodiment of the present application.
Figure 6:
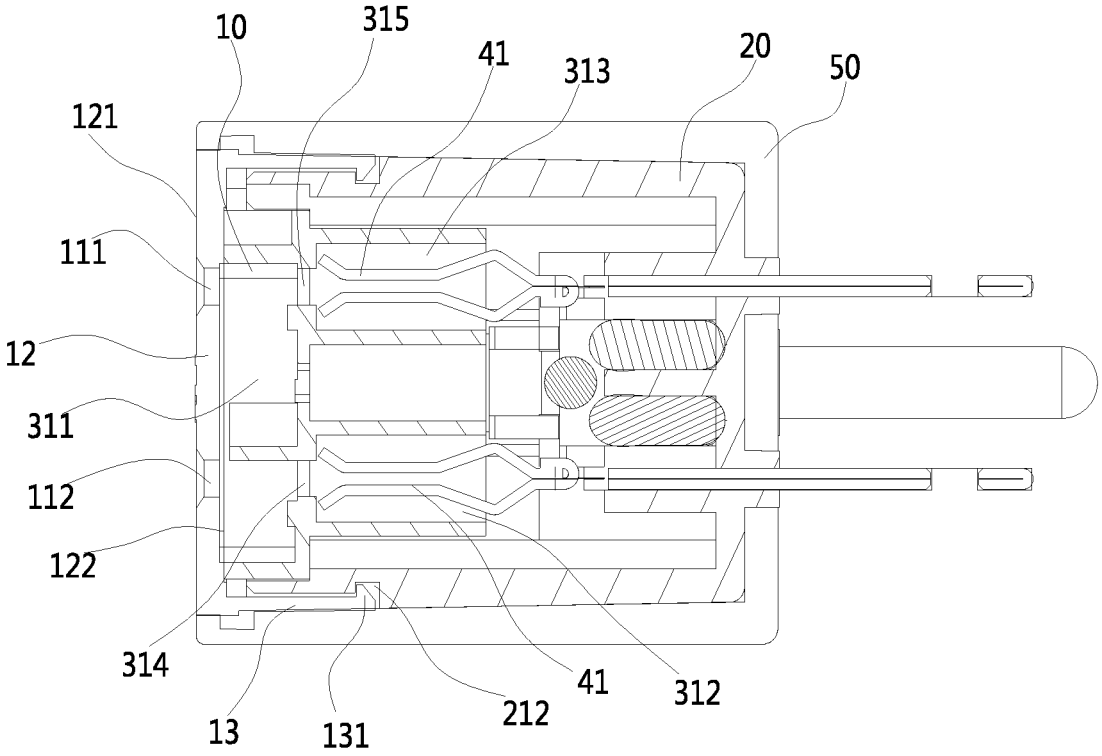
FIG. 6 is a cross sectional view of a pass-through plug provided by an embodiment of the present application, wherein a shutter assembly is removed.

In the present embodiment, as shown in FIGS. 5-6, the first connecting plate 13 and the second connecting plate 14 respectively extend along opposite sides of the plate portion 12 toward the second housing 20. That is, the first connecting plate 13 and the second connecting plate 14 are preferably parallel to each other; of course, in other embodiments, the first connecting plate 13 and the second connecting plate 14 are perpendicular to each other to achieve the technical effect of the present application.

In an embodiment of the present application, as shown in FIGS. 5-6, the frame portion of the second housing 20 includes a first side plate 21 and a second side plate 22 that are parallel to each other. The first side plate 21 is recessed with a first connection groove 211 for connecting the first connecting plate 13. The second side plate 22 is provided with a second connection groove 221 for connecting the second connecting plate 14. At the same time, the bottom end of the first connection groove 211 is further recessed with a first groove 212 for the first engagement portion 131 to be engaged, and the bottom end of the second connection groove 221 is further recessed with a second groove 222 for the second engagement portion 141 to be engaged.

Furthermore, when assembling the first housing 10 and the second housing 20, the first connecting plate 13 is moved along the direction of the first connection groove 211, and the second connecting plate 14 is moved along the direction of the second connection groove 221, such that the first engagement portion 131 at the end of the first connecting plate 13 is engaged into the first groove 212, and the second engagement portion 141 at the end of the second connecting plate 14 is engaged into the second groove 222; thereby achieving a fixed connection between the first housing 10 and the second housing 20. such that first housing 10 and the second housing 20 are fixedly connected through a one-time snap feature in place of using screws to fasten the assembly together.

In the present embodiment, the first connection groove 211 may be provided on the inner surface or the outer surface of the first side plate 21. The second connection groove 221 may be provided on the inner surface or the outer surface of the second side plate 22.

In an embodiment of the present application, as shown in FIGS. 5-10, the tamper resistant assembly 30 includes: a supporting member 31 and a shutter member 32 limited into the supporting member 31 and able to move relative to the supporting member 31 and the first housing 32.

In the present embodiment, as shown in FIGS. 5-10, the supporting member 31 includes a receiving groove 311, and at least a first channel 312 and a second channel 313 extending vertically outward along the bottom of the receiving groove 311; for ease of description, in the present application, the number of sockets 11 on the first housing 10 is three, and the channels extending from the bottom of the receiving groove 311 correspond to two, and there is also a channel for the ground pin; of course, other numbers can be used according to actual needs.

In the present embodiment, as shown in FIGS. 5-8, the bottom of the receiving groove 311 is provided with a first insertion slot 314 and a second insertion slot 315 corresponding to the first socket 111 and the second socket 112 in parallel. The first insertion slot 314 communicates with the first channel 312, and the second insertion slot 315 communicates with the second channel 313. Furthermore, when the shutter member 32 does not block the first insertion slot 314 and the second insertion slot 315, the pins of the external plug can pass through the first slot 111 and the first insertion slot 314 in sequence, and the second slot 112 and the second insertion slot 315 in sequence to achieve plug-in. When the shutter member 32 blocks the first insertion slot 314 and the second insertion slot 315, the pins of the external plug will be blocked by the shutter member 32 so as not to pass through the first insertion slot 314 and the second insertion slot 315; thereby avoiding external foreign objects from contacting the electrical components inside the pass-through plug of the present application, that is, avoiding electric shock accidents when accidentally touched.

Figure 7:
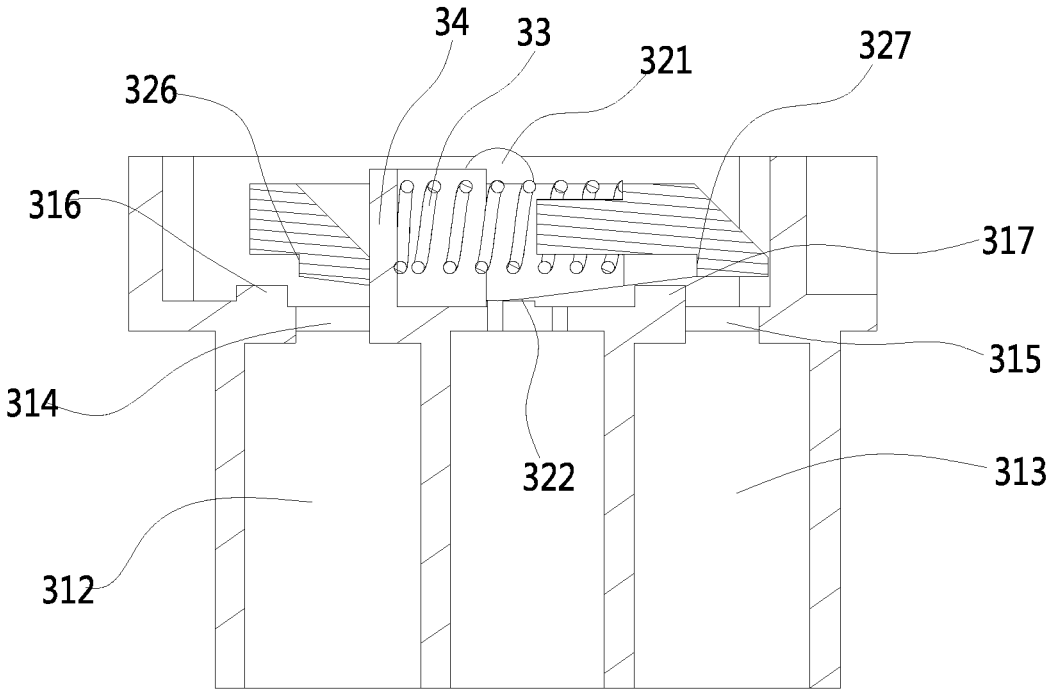
FIG. 7 is a cross-sectional view of a tamper resistant assembly in a pass-through plug provided by an embodiment of the present application.
Figure 8:
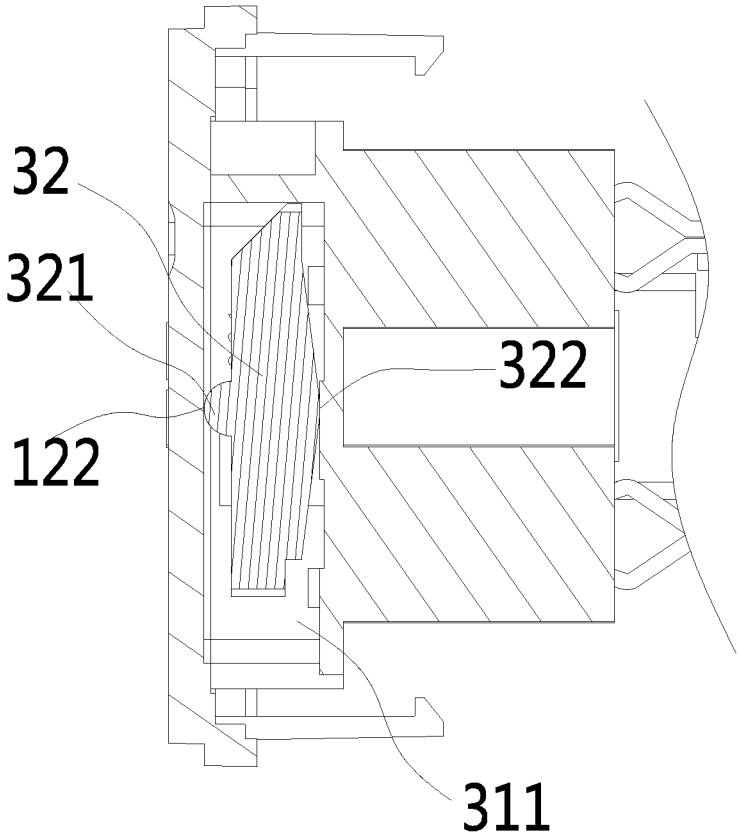
FIG. 8 is a cross sectional view of a pass-through plug provided by an embodiment of the present application, wherein an upper arch portion and a lower arch portion of the shutter assembly are shown.
Figure 9:
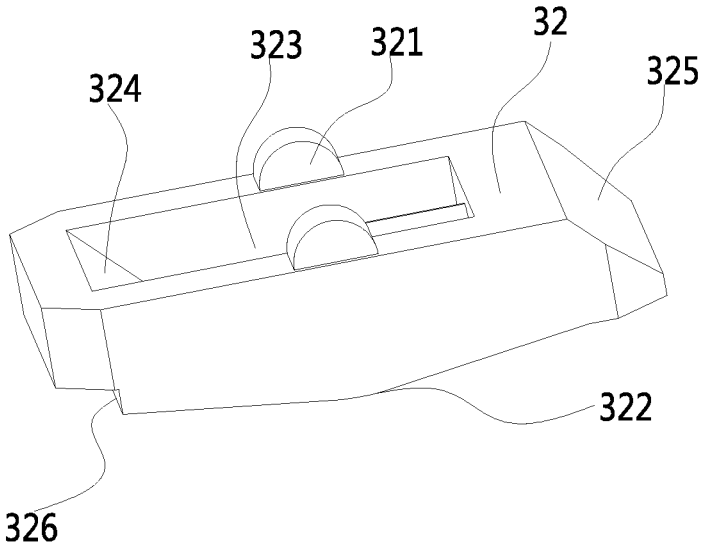
FIG. 9 is a perspective structural view of a shutter assembly of a pass-through plug provided by an embodiment of the present application.
Figure 10:
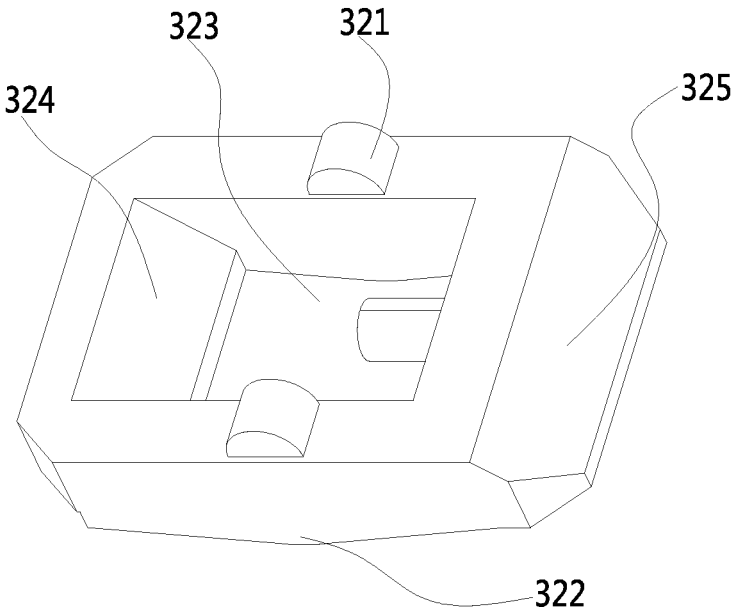
FIG. 10 is a perspective structural view of a shutter assembly of a pass-through plug provided by an embodiment of the present application.

Specifically, in an embodiment of the present application, as shown in FIGS. 7-8, the shutter member 32 is in a block shape and includes an upper arch portion 321 and a lower arch portion 322. The upper arch portion 321 includes at least one hump, and the outer surface of the hump is arc-shaped. The top end of the at least one hump abuts the second surface 122 of the plate portion 12. In this embodiment, the lower arch portion 322 is preferably an inverted triangle, and the outermost end of the lower arch portion 322 abuts the bottom surface of the receiving groove 311. Furthermore, when one of the first socket 111 or the second socket 112 is operated, the contact point of the upper arch portion 321 of the shutter member 32 and the second surface 122 of the plate portion 12, and the contact point of the lower arch portion 322 and the bottom of the receiving groove 311 are acted as pivot points for rotation; such that the communication between the first socket 111 and the first insertion slot 314, or the second socket 112 and the second insertion slot 315 is blocked.

Further, as shown in FIGS. 7-8, the shutter member 32 is also provided with a through groove 323, and the bottom of the receiving groove 311 extends vertically upward to form a limiting portion 34 passing through the through groove 323. In addition, in order to ensure the recoverability of the shutter member 32 relative to the receiving groove 311 when it is moved in the receiving groove 311, a return spring 33 is connected between the limiting portion 34 and the opposite side wall of the through groove 323. The return spring 33 moves in a direction parallel to the bottom of the receiving groove 311.

Further, as shown in FIGS. 7-8, the surfaces of the shutter member 32 facing the first socket 111 and the second socket 112 are a first inclined surface 324 and a second inclined surface 325, respectively, so that when the first socket 111 and the second socket 112 are operated simultaneously, the force acting on the first inclined surface 324 and the second inclined surface 325 can drive the shutter member 32 to slide in the receiving groove 311, so that the first socket 111 communicates with the first insertion slot 314, and the second socket 112 communicates with the second insertion slot 315.

Further, as shown in FIGS. 7-8, a first step 326 and a second step 327 are formed on the lower surface of the shutter member 32, and a first boss 316 and a second bosses 317 are also provided on the bottom of the receiving groove 311, correspondingly. When the shutter member 32 rotates, the first step 326 abuts on the first boss 316 or the second step 327 abuts on the second boss 317 to prevent the shutter member 32 from sliding in the receiving groove 311.

Based on the above-mentioned structural arrangement, the shutter member 32 can be limited in the receiving groove 311, and can rotate relative to the receiving groove 311 to block the plurality of sockets 11 or slide in the receiving groove 311 so that the plurality of sockets 11 and the first insertion slot 314 and the second insertion slot 315 correspondingly communicate with each other.

Figure 11:
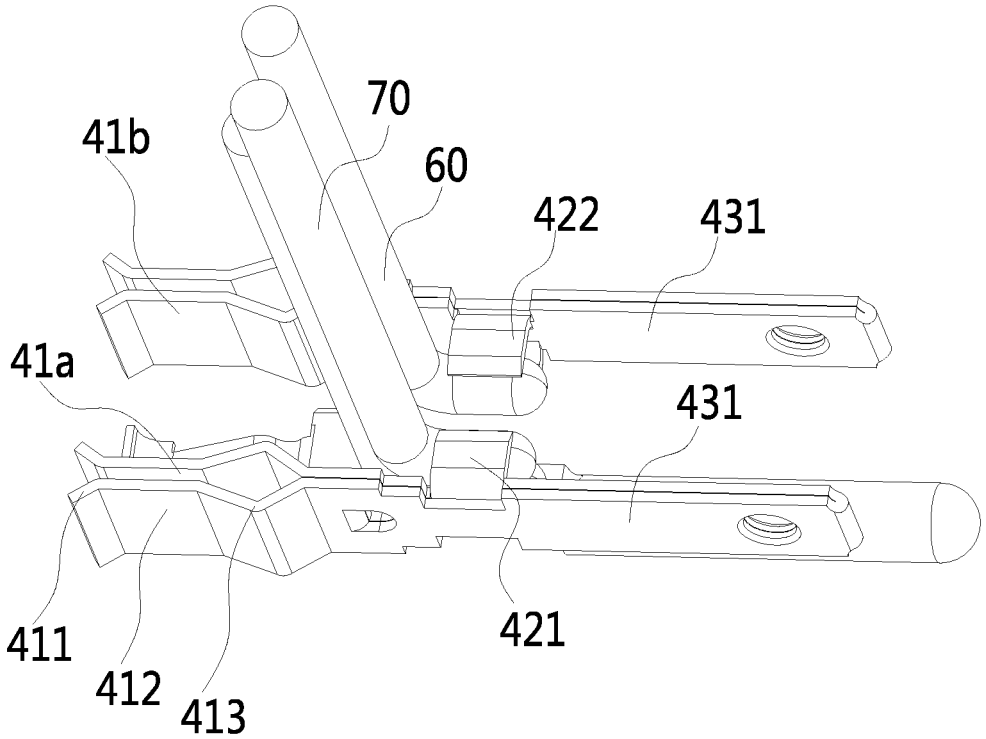
FIG. 11 is a perspective structural view of a prong assembly of a pass-through plug provided by an embodiment of the present application.

In an embodiment of the present application, as shown in FIGS. 3-4 and 11, the pass-through plug further includes a prong assembly 40; the prong assembly 40 is trapped between the tamper resistant assembly 30 and the second housing 20. Here, the prong assembly 40 is trapped between the tamper resistant assembly 30 and the second housing 20, which means that the prong assembly 40 is limited only by the position between the tamper resistant assembly 30 and the second housing 20, so as to realize the fixing and connection of the prong assembly 40, the fixing of the prong assembly 40 is simple and steady.

In an embodiment of the present application, as shown in FIGS. 3-4 and 11, the prong assembly 40 includes a pin part 43 protruding from the second housing 20 and a prong part 41 contacting the tamper resistant assembly 30, and a wiring part 42 for connecting cables. In this embodiment, the pin part 43, the prong part 41 and the wiring portion 42 are preferably integrally formed, that is, as a whole. The prong part 41 is connected to the first channel 312 and the second channel 313 of the supporting member 31 of the tamper resistant assembly 30, such that electric connection can be realized by contacting the pins of the external plugs passing through the plurality of sockets 11 and the first insertion slot 314 and the second insertion slot 315 when the plurality of sockets 11 are simultaneously operated. The wiring part 42 is located between the pin part 43 and the prong part 41, and configured to fixedly connect the cables, so that the pass-through plug can also be used as a plug alone. The pin part 43 passes through the second housing 20 for inserting into a socket, so as to realize the electrical connection of the pass-through plug.

In an embodiment of the present application, as shown in FIGS. 3-4 and 11, the wiring part 42 includes a first connection portion 421 for fixedly connecting at least one first cable 70, and a second connecting portion 422 for fixedly connecting at least one second cable 60. The first connection portion 421 and the second connection portion 422 are preferably arranged perpendicular to the pin part 43, so as to ensure that the cables are fixedly connected while being used as a stopper to abut against the inner wall surface of the second housing 20, to prevent the entire prong assembly 40 from extending out of the second housing 20 when pulling out of the pass-through plug.

Figure 12:
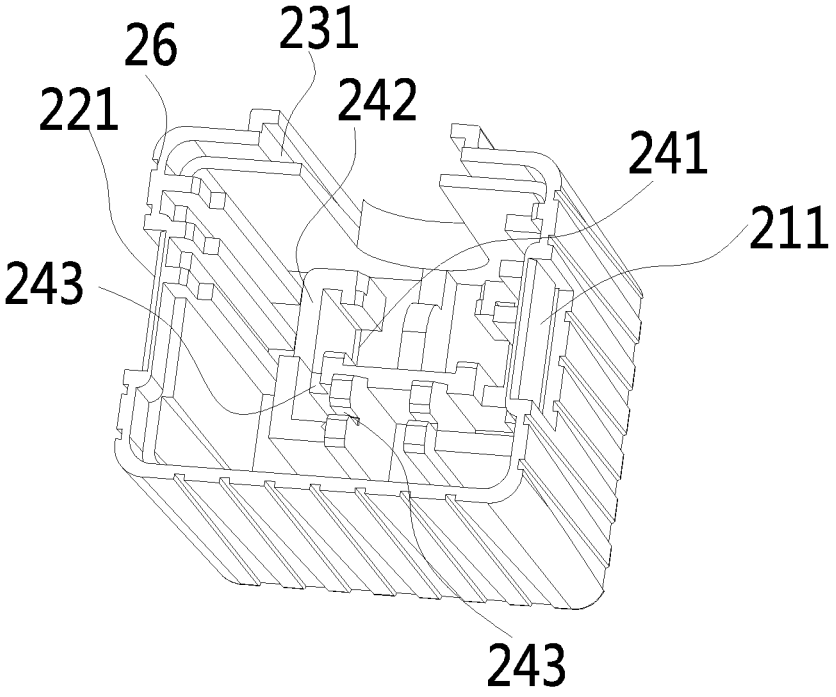
FIG. 12 is a perspective structural view of a second housing of a pass-through plug provided by an embodiment of the present application.

In an embodiment of the present application, as shown in FIGS. 3-4 and 12, the frame portion of the second housing 20 includes a third side plate 24 on a side away from the opening 25. The third side plate 24 is provided with a plurality of slots 241 for allowing the pins 431 of the pin part 43 to pass through the second housing 20. In addition, in order to protect the plurality of pins 431, a plurality of flanges 242 corresponding to the peripheral edges of the plurality of slots 241 are formed along the inner side wall of the third side plate 24 to extend vertically to the inside of the frame portion. The flange 242 is configured to correspondingly connect the wiring part 42.

In the present embodiment, as shown in FIGS. 3-4 and 12, the flanges 242 are formed by extending around the outer circumference of the slots, and the extended ends of the flanges 242 are further provided with connection grooves 243 for limiting and connecting the wiring part 42. In the present application, the connection grooves 243 are arranged so that after the plurality of pins 431 of the pin part 43 pass through the slot 241, the first connection portion 421 and the second connection portion 422 that are perpendicular to the pin part 43 are both limitedly connected to the connection grooves 243. In this way, the cables connected to the first connection portion 421 and the second connection portion 422 are remaining stable during use; at the same time, the prong assembly 40 is prevented from being damaged.

In an embodiment of the present application, as shown in FIG. 11, the prong part 41 includes at least a first prong connection member 41*a* abutting against the first insertion slot 314 and a second prong connection member 41*b* abutting against the second insertion slot 315. The first prong connection member 41*a* and the second prong connection member 41*b* are configured to be in contact with the pins of the external plug when the plurality of sockets 11 are simultaneously operated.

In the present embodiment, as shown in FIG. 11, the first prong connection member 41*a* and the second prong connection member 41*b* respectively abut into the first channel 312 and the second channel 313, and are respectively corresponding to the first insertion slot 314 and the second insertion slot 315. Furthermore, one end of the entire prong assembly 40 abuts in the first channel 312 and the second channel 313 of the tamper resistant assembly 30, and the other side is connected to the connection groove 243 of the flanges 242 by the first connection portion 421 and the second connection portion 422, such that the entire prong assembly 40 can be stably connected between the first housing 10 and the second housing 20 to avoid loosening of the pins.

In an embodiment of the present application, as shown in FIG. 11, the structure of the first prong connection member 41*a* and the second prong connection member 41*b* are the same. Here, the first prong connection member 41*a* is taken as an example for description. The first prong connection member r 41*a* includes a first portion 411 having a funnel shape at the front end of the first prong connection member 41*a*. Herein, the cross-sectional area of the first channel 312 and the second channel 313 of the tamper resistant assembly 30 is preferably larger than the area of the first insertion slot 314 and the second insertion slot 315, respectively, such that the end of the first portion 411 can abut on the bottom wall of the first channel 312 and keep the funnel-shaped opening facing the first insertion slot 314.

The first prong connection member 41*a* further includes a flat second portion 412 connected to the first portion 411 to contact the external pin. The second portion 412 includes two metal sheets parallel to each other, and there is a gap between the two metal sheets. The gap is used to allow the pins of the external plug to pass between the two metal sheets and maintain close contact with the metal sheets.

The first prong connection member 41*a* further includes a third portion 413 connected to the second portion 412 and expanded to strengthen the strength of the first prong connection member 41*a*. The arrangement of the third part 413 can strengthen the strength of the second part 412 so that the second portion 412 is in close contact with the pins of the external plug.

In an embodiment of the present application, as shown in FIGS. 3-4, the frame portion further includes a fourth side plate 23, and the fourth side plate 23 is provided with a slot through which the cable can pass through. Alternatively, the frame portion further includes a fourth side plate 23, the fourth side plate 23 is provided with a sliding groove 231, one end of the sliding groove 231 faces the opening 25, and the other end thereof forms an arc-shaped end 232; the plate portion further includes a third connection plate 15 extended outwardly perpendicular to the second surface 122 to be slidably connected to the sliding groove 231. The extending end of the third connection plate 15 is concavely formed with an arc-shaped inner arch. The inner arch 151 and the arc-shaped end 232 of the sliding groove 231 form a channel for the cables to pass through.

In an embodiment of the present application, as shown in FIGS. 1-4, a protective cover 50 is molded outside the first housing 10 and the second housing 20, and the protective cover 50 can also be injection molded at outside of the first housing 10 and the second housing 20, to protect the entire first housing 10 and the second housing 20.

In another embodiment of the present application, as shown in FIGS. 1-4, the pass-through plug further includes a protective cover 50 molded outside the first housing 10 and the second housing 20, and an outer surface of the plate portion 12 further provided with a connection step 16 to which the protective cover 50 is able to be attached. Furthermore, it can be ensured that the plate portion 12 is exposed outside the protective cover 50 and the fastening of the protective cover 50 to the connection of the first housing 10 and the second housing 20 can also be ensured.

In an embodiment of the present application, as shown in FIGS. 1-4, the outer surface of the second housing 20 is also formed with a plurality of recesses 26 for enhancing the adhesion strength of the protective cover 50 and the second housing 20. The arrangement of the plurality of recesses 26 can strengthen the surface area of the protective cover 50 in contact with the second housing 20.

In an embodiment of the present application, as shown in FIGS. 1-4, the protective cover 50 is also formed with an auxiliary handle 51 that is convenient for pulling out the pass-through plug. Further, the auxiliary handle 51 is designed to prevent a mating plug from being plugged in upside down and thereby preventing the ground pin from being exposed.

The aforementioned embodiments are only preferred embodiments of the present application, and should not be regarded as being limitation to the present application. Any modification, equivalent replacement, improvement, and so on, which are made within the spirit and the principle of the present application, should be included in the protection scope of the present application.

Aspect:

Aspect 1, A pass-through plug, comprising:

a first housing, comprising a plurality of sockets;

a second housing, configured to be connected with the first housing; and a tamper resistant assembly, trapped between the first housing and the second housing and configured to selectively block the plurality of sockets when the plurality of sockets are not simultaneously operated.

Aspect 2. The pass-through plug of aspect 1, wherein the first housing comprises a plate portion, the second housing comprises a frame portion with an end providing an opening, and the plate portion closing the opening when the first housing is connected with the second housing.

Aspect 3. The pass-through plug any one of preceding aspects, wherein the plate portion is configured for the plurality of sockets to pass through, and comprises a first surface and a second surface opposite to the first surface; and the first housing further comprises:

a first connecting plate, extending outwardly perpendicular to the second surface, and an extending end of the first connecting plate is provided with a first engagement portion; and a second connecting plate, extending outwardly perpendicular to the second surface, and an extending end of the second connecting plate is provided with a second engagement portion;

wherein the first engagement portion and the second engagement portion are engaged onto the second housing when the first housing is connected with the second housing.

Aspect 4. The pass-through plug any one of preceding aspects, wherein the second housing comprises:

a frame portion, comprising a first side plate and a second side plate that are perpendicular to each other, the first side plate being provided with a first connection groove configured for connecting the first connecting plate, and the second side plate being provided with a second connection groove configured for connecting the second connecting plate; and wherein a bottom of the first connection groove is further provided with a first groove configured for the first engagement portion to be engaged, and a bottom of the second connection groove is further provided with a second groove configured for the second engagement portion to be engaged.

Aspect 5. The pass-through plug any one of preceding aspects, wherein the tamper resistant assembly comprises:

a supporting member, providing with a receiving groove, and a bottom of the receiving groove being provided with at least a first insertion slot and a second insertion slot that are in parallel; and a shutter assembly, limited into the receiving groove and configured to rotate relative to the receiving groove to block the plurality of sockets, or to slide such that the plurality of sockets communicate with the first insertion slot and the second insertion slot respectively.

Aspect 6. The pass-through plug any one of preceding aspects, wherein the shutter assembly comprises an upper arch portion and a lower arch portion, a top of the upper arch portion being movably in contact with the plate portion, and a top of the lower arch portion being movably in contact with a bottom of the receiving groove.

Aspect 7. The pass-through plug any one of preceding aspects, wherein the upper arch portion is configured to be able to slide at the plate portion when the plurality of sockets are not simultaneously operated, and to rotate relative to the plate portion when the plurality of sockets are simultaneously operated; and the lower arch portion is configured to be able to slide on the bottom of the receiving groove when the plurality of sockets are not simultaneously operated, and to rotate relative to the bottom of the receiving groove when the plurality of sockets are simultaneously operated.

Aspect 8. The pass-through plug any one of preceding aspects, wherein the pass-through plug further comprises a prong assembly trapped between the tamper resistant assembly and the second housing.

Aspect 9. The pass-through plug any one of preceding aspects, wherein the prong assembly comprises:

a pin part, extending out of the second housing;

a prong part, configured to be abutted against the tamper resistant assembly; and a wiring part, configure to connect cables.

Aspect 10. The pass-through plug any one of preceding aspects, wherein the wiring part comprises a first connection portion configured to fixedly connect at least one first cable, and second connection portion configured to fixedly connect at least one second cable, wherein the first connection portion and the second connection portion are limited and abutted against at an inner wall of the frame portion when the pin part is extended outside of the second housing.

Aspect 11. The pass-through plug any one of preceding aspects, wherein the frame portion comprises a third side plate opposite to the opening, and the third side plate being provided with a plurality of slots configured for the pin part to be passed through the second housing, wherein a plurality of flanges corresponding to the plurality of slots are formed along the inner wall of the third side plate and extending perpendicularly to an inside of the frame portion, and the flanges being configured for the wiring part to be correspondingly connected thereon.

Aspect 12. The pass-through plug any one of preceding aspects, wherein the flange is formed by extending around outer circumference of the slots, and extending ends of the flanges are further provided with connecting grooves for limiting the wiring part.

Aspect 13. The pass-through plug any one of preceding aspects, wherein the prong part comprises at least a first prong connection member abutted the first insertion slot and a second prong connection member abutted the second insertion slot, and the first prong connection member and the second prong connection member being configured to in contact with external pins passing through the first insertion slot and the second insertion slot when the plurality of sockets are simultaneously operated.

Aspect 14. The pass-through plug any one of preceding aspects, wherein the first prong connection member and the second prong connection member have the same structure; and the first prong connection member comprises a first portion having a funnel-shaped and located at a front end; a flat second portion connected with the first portion and configured to in contact with the external pins; and a third portion connected with the second portion and expanded to strengthen the strength of the first prong connection member.

Aspect 15. The pass-through plug any one of preceding aspects, wherein the frame portion further comprises a fourth side plate provided with a slot configured for the cables to pass through.

Aspect 16. The pass-through plug any one of preceding aspects, wherein the frame portion further comprises a fourth side plate provided with a sliding groove, and an end of the sliding groove facing the opening, and the other end of the sliding groove forming an arc-shaped end;

the plate portion is configured for the plurality of sockets to pass through, and comprises a first surface and a second surface opposite to the first surface; the plate portion further comprises a third connection plate extended outwardly perpendicular to the second surface, to slidably connect to the sliding groove, and wherein an extending end of the third connection plate is concavely provided with an arc-shaped inner arch, and the inner arch and the arc-shaped end of the sliding groove forming a channel for the cables to pass through.

Aspect 17. The pass-through plug any one of preceding aspects, wherein the pass-through plug further comprises a protective cover molded outside the first housing and the second housing.

Aspect 18. The pass-through plug any one of preceding aspects, wherein the pass-through plug further comprises a protective cover molded outside the first housing and the second housing, and an outer surface of the plate portion further provided with a connection step to which the protective cover is able to be attached.

Aspect 19. The pass-through plug any one of preceding aspects, wherein an outer surface of the second housing further comprises a plurality of recesses configured to enhance adhesion strength of the protective cover to the second housing.

Aspect 20. The pass-through plug any one of preceding aspects, wherein the protective cover further comprises an auxiliary handle configured to facilitate pulling out the pass-through plug.

What is claimed is:

1. A pass-through plug, comprising:

a first housing, comprising a plurality of sockets;

a second housing, configured to be connected with the first housing;

a tamper resistant assembly, trapped between the first housing and the second housing and configured to selectively block the plurality of sockets when the plurality of sockets are not simultaneously operated;

wherein the first housing comprises a plate portion, the second housing comprises a frame portion with an end providing an opening, and the plate portion closing the opening when the first housing is connected with the second housing; and wherein the tamper resistant assembly comprises:

a supporting member, providing with a receiving groove, and a bottom of the receiving groove being provided with at least a first insertion slot and a second insertion slot that are in parallel; and a shutter assembly, limited into the receiving groove and configured to rotate relative to the receiving groove to block the plurality of sockets, or to slide such that the plurality of sockets communicate with the first insertion slot and the second insertion slot respectively.

2. The pass-through plug of claim 1, wherein the plate portion is configured for the plurality of sockets to pass through, and comprises a first surface and a second surface opposite to the first surface; and the first housing further comprises:

a first connecting plate, extending outwardly perpendicular to the second surface, and an extending end of the first connecting plate is provided with a first engagement portion; and a second connecting plate, extending outwardly perpendicular to the second surface, and an extending end of the second connecting plate is provided with a second engagement portion;

wherein the first engagement portion and the second engagement portion are engaged onto the second housing when the first housing is connected with the second housing.

3. The pass-through plug of claim 2, wherein the second housing comprises:

a frame portion, comprising a first side plate and a second side plate that are perpendicular to each other, the first side plate being provided with a first connection groove configured for connecting the first connecting plate, and the second side plate being provided with a second connection groove configured for connecting the second connecting plate; and wherein a bottom of the first connection groove is further provided with a first groove configured for the first engagement portion to be engaged, and a bottom of the second connection groove is further provided with a second groove configured for the second engagement portion to be engaged.

4. The pass-through plug of claim 1, wherein the shutter assembly comprises an upper arch portion and a lower arch portion, a top of the upper arch portion being movably in contact with the plate portion, and a top of the lower arch portion being movably in contact with a bottom of the receiving groove.

5. The pass-through plug of claim 4, wherein the upper arch portion is configured to be able to slide at the plate portion when the plurality of sockets are not simultaneously operated, and to rotate relative to the plate portion when the plurality of sockets are simultaneously operated; and the lower arch portion is configured to be able to slide on the bottom of the receiving groove when the plurality of sockets are not simultaneously operated, and to rotate relative to the bottom of the receiving groove when the plurality of sockets are simultaneously operated.

6. The pass-through plug of claim 1, wherein the pass-through plug further comprises a prong assembly trapped between the tamper resistant assembly and the second housing.

7. The pass-through plug of claim 6, wherein the prong assembly comprises:

a pin part, extending out of the second housing;

a prong part, configured to be abutted against the tamper resistant assembly; and a wiring part, configure to connect cables.

8. The pass-through plug of claim 7, wherein the wiring part comprises a first connection portion configured to fixedly connect at least one first cable, and second connection portion configured to fixedly connect at least one second cable, wherein the first connection portion and the second connection portion are limited and abutted against at an inner wall of the frame portion when the pin part is extended outside of the second housing.

9. The pass-through plug of claim 7, wherein the frame portion comprises a third side plate opposite to the opening, and the third side plate being provided with a plurality of slots configured for the pin part to be passed through the second housing, wherein a plurality of flanges corresponding to the plurality of slots are formed along the inner wall of the third side plate and extending perpendicularly to an inside of the frame portion, and the flanges being configured for the wiring part to be correspondingly connected thereon.

10. The pass-through plug of claim 9, wherein the flange is formed by extending around outer circumference of the slots, and extending ends of the flanges are further provided with connecting grooves for limiting the wiring part.

11. The pass-through plug of claim 7, wherein the prong part comprises at least a first prong connection member abutted the first insertion slot and a second prong connection member abutted the second insertion slot, and the first prong connection member and the second prong connection member being configured to in contact with external pins passing through the first insertion slot and the second insertion slot when the plurality of sockets are simultaneously operated.

12. The pass-through plug of claim 11, wherein the first prong connection member and the second prong connection member have the same structure; and the first prong connection member comprises a first portion having a funnel-shaped and located at a front end; a flat second portion connected with the first portion and configured to in contact with the external pins; and a third portion connected with the second portion and expanded to strengthen the strength of the first prong connection member.

13. The pass-through plug of claim 7, wherein the frame portion further comprises a fourth side plate provided with a slot configured for the cables to pass through.

14. The pass-through plug of claim 7, wherein the frame portion further comprises a fourth side plate provided with a sliding groove, and an end of the sliding groove facing the opening, and the other end of the sliding groove forming an arc-shaped end;

the plate portion is configured for the plurality of sockets to pass through, and comprises a first surface and a second surface opposite to the first surface; the plate portion further comprises a third connection plate extended outwardly perpendicular to the second surface, to slidably connect to the sliding groove, and wherein an extending end of the third connection plate is concavely provided with an arc-shaped inner arch, and the inner arch and the arc-shaped end of the sliding groove forming a channel for the cables to pass through.

15. The pass-through plug of claim 1, and an outer surface of the plate portion further provided with a connection step to which the protective cover is able to be attached.

16. The pass-through plug of claim 1, wherein an outer surface of the second housing further comprises a plurality of recesses configured to enhance adhesion strength of the protective cover to the second housing.

17. The pass-through plug of claim 1, wherein the protective cover further comprises an auxiliary handle configured to facilitate pulling out the pass-through plug.

18. A pass-through plug, comprising:

a first housing, comprising a plurality of sockets;

a second housing, configured to be connected with the first housing; and a tamper resistant assembly, trapped between the first housing and the second housing and configured to selectively block the plurality of sockets when the plurality of sockets are not simultaneously operated;

wherein the first housing comprises a plate portion, the second housing comprises a frame portion with an end providing an opening, and the plate portion closing the opening when the first housing is connected with the second housing; and wherein the pass-through plug further comprises a protective cover molded outside the first housing and the second housing, and an outer surface of the plate portion further provided with a connection step to which the protective cover is able to be attached.

* * * * *